US007504017B2

(12) United States Patent
Cardarelli

(10) Patent No.: US 7,504,017 B2
(45) Date of Patent: Mar. 17, 2009

(54) METHOD FOR ELECTROWINNING OF TITANIUM METAL OR ALLOY FROM TITANIUM OXIDE CONTAINING COMPOUND IN THE LIQUID STATE

(75) Inventor: Francois Cardarelli, Saint-Léonard (CA)

(73) Assignee: QIT-Fer et Titane Inc., Sorel-Tracy (CA)

( * ) Notice: Subject to any disclaimer, the term of this patent is extended or adjusted under 35 U.S.C. 154(b) by 115 days.

(21) Appl. No.: 10/450,864

(22) PCT Filed: Nov. 22, 2002

(86) PCT No.: PCT/CA02/01802

§ 371 (c)(1),
(2), (4) Date: Aug. 6, 2003

(87) PCT Pub. No.: WO03/046258

PCT Pub. Date: Jun. 5, 2003

(65) Prior Publication Data

US 2004/0194574 A1 Oct. 7, 2004

(30) Foreign Application Priority Data

Nov. 22, 2001 (CA) ..... 2363647
Nov. 22, 2001 (CA) ..... 2363648

(51) Int. Cl.
*C25C 3/28* (2006.01)

(52) U.S. Cl. ..... 205/398; 205/399; 205/400; 205/401

(58) Field of Classification Search ..... None
See application file for complete search history.

(56) References Cited

U.S. PATENT DOCUMENTS 2,205,854 A 6/1940 Kroll (Continued)

FOREIGN PATENT DOCUMENTS

EP 210961 A1 4/1987

(Continued)

OTHER PUBLICATIONS

International Search Report for PCT/CA02/01802 mailed Jun. 20, 2003.

(Continued)

*Primary Examiner*—Harry D Wilkins, III
(74) *Attorney, Agent, or Firm*—John Bruckner PC

(57) ABSTRACT

This invention relates to a method for electrowinning of titanium metal or titanium alloys from electrically conductive titanium mixed oxide compounds in the liquid state such as molten titania slag, molten ilmenite, molten leucoxene, molten perowskite, molten titanite, molten natural or synthetic rutile or molten titanium dioxide. The method involves providing the conductive titanium oxide compound at temperatures corresponding to the liquid state, pouring the molten material into an electrochemical reactor to form a pool of electrically conductive liquid acting as cathode material, covering the cathode material with a layer of electrolyte, such as molten salts or a solid state ionic conductor, deoxidizing electrochemically the molten cathode by direct current electrolysis. Preferably, the deoxidizing step is performed at high temperature using either a consumable carbon anode or an inert dimensionally stable anode or a gas diffusion anode. During the electrochemical reduction, droplets of liquid titanium metal or titanium alloy are produced at the slag/electrolyte interface and sink by gravity settling to the bottom of the electrochemical reactor forming, after coalescence, a pool of liquid titanium metal or titanium alloy. Meanwhile carbon dioxide or oxygen gas is evolved at the anode. The liquid metal is continuously siphoned or tapped under an inert atmosphere and cast into dense and coherent titanium metal or titanium alloy ingots.

17 Claims, 3 Drawing Sheets

U.S. PATENT DOCUMENTS

| | | | | | |
|---|---|---|---|---|---|
| 2,994,650 | A | * | 8/1961 | Slatin | 205/47 |
| 3,282,822 | A | | 11/1966 | Priscu | |
| 4,118,291 | A | | 10/1978 | Juckniess | |
| 4,338,177 | A | * | 7/1982 | Withers et al. | 204/247.3 |
| 4,381,976 | A | | 5/1983 | Armand | |
| 4,396,472 | A | | 8/1983 | Armand | |
| 4,422,917 | A | | 12/1983 | Hayfield | |
| 4,897,179 | A | * | 1/1990 | Mori et al. | 208/127 |
| 4,964,973 | A | | 10/1990 | Donahue et al. | |
| 5,006,209 | A | * | 4/1991 | Beck et al. | 205/336 |
| 5,976,345 | A | | 11/1999 | Pal | |
| 6,074,045 | A | | 6/2000 | Ginatta | |
| 6,117,208 | A | | 9/2000 | Sharma | |
| 6,117,302 | A | * | 9/2000 | Roha | 205/343 |
| 6,245,211 | B1 | | 6/2001 | Fortin | |
| 6,299,742 | B1 | | 10/2001 | Pal | |

FOREIGN PATENT DOCUMENTS

| | | | |
|---|---|---|---|
| JP | 62-63626 | | 3/1987 |
| JP | 5-503314 | | 4/1990 |
| JP | 8-225980 | | 9/1996 |
| JP | 2001-509842 | | 8/1998 |
| JP | 11-246919 | | 9/1999 |
| WO | WO 8910437 | A1 | 11/1989 |
| WO | WO 99/64638 | A1 | 10/1990 |
| WO | WO 01/62996 | A1 | 8/2001 |
| WO | WO 0162994 | A1 | 8/2001 |
| WO | WO 0162996 | A1 | 8/2001 |

OTHER PUBLICATIONS

Cardelli, F., "*Materials Handbook: A Concise Dektop Reference*" Springer-Verlag, London, New York, pp. 115-135 (2001).

Gambogi, J. "Titanium and Titanium Dioxide" from *Mineral Commodity Summaries*, U.S. Bureau of Mines, p. 180 (1995).

Gambogi, J. "*Annual Report: Titanium-1992*" U.S. Bureau of Mines, p. 1 (1993).

Kroll, W.J., "Trans. Electrochem. Soc" 112, pp. 35-47 (1940).

National Materials Advisory Board Committee on Direct Reduction Processes for the Production of Titanium Metal, Report #NMAB-304, National Academy of Sciences, Washington, D.C. (1974).

Kolthoff, et al. "Polarography in acentonitrile of titanium tetrachloride and tetraiodid in various support electrolytes", Journal of Eletrochem. Soc. vol. 111(9), pp. 1065-1074 (1964).

Sinha, et al. "Indian Mining J. Spec." vol. 1, p. 134 (1975).

Kudryatsev, et al. "Hydrog. Met. Proc. Int. Cong. 2nd." Pergamon Process, Oxford, p. 5, 1977.

Sofronkov, et al. "Prikl. Khim", vol. 51, p. 607, 1978.

Bribiesca, et al. "Electrowinning of titanium from sulfuric acid titanium solutions", *Proc. Titanium '92*, The Minerals, Metals and Materials Society, pp. 2443-2444, 1993.

Biallozor, S., et al. "Electrochim. Acta" vol. 25, p. 1209 (1980).

Lisowska, et al. "Electrochim. Acta" vol. 27, p. 105 (1982).

Hashimoto, et al. "*Electrowinning of titanium from its oxides, Part III., Electrowinning of Titanium Dioxide of Calcium Titanate in Calcium*" Denki Kagaku, vol. 40, pp. 39-44, (1972).

Cobel, et al. "*Electrowinning of titanium from titanium tetrachloride: Pilot Plant Experience and Production Plant Projections*" Conference: Titanium '80, Science and Technology, vol. 3, Kyoto, Japan, pp. 19-22, May 1980.

DiMaria, "*RMI Gets License to Make New Type of Titanium*", Metalworking News, Feb. 1, 1988.

Kawakami, et al. "*The Possibility of electrowinning of Liquid Titanium Using ESR Apparatus*, " Proc. Int. Conf. Molten Slags, Fluxes Salts '97, 5th, pp. 477-482, Warrendaled, PA, (1997).

Takenaka, et al. "*The New Concept for Electrowinning Process of Liquid Titanium Metal in Molten Salt*" Electrochemistry, vol. 67, pp. 661-668 (1999).

Takenaka, et al. "*Direct Electrowinning of Liquid Titanium Metal by Using Direct Current Electro Slag Remelting Apparatus*" Proc. Electrochem. Soc. (Molten Salts XII), pp. 99-41, 578-584 (2000).

Chen, et al. "*Direct electrochemical Reduction of Titanium Dioxide to Ttitanium in Molten Calcium Chloride*" Nature, vol. 407, pp. 361-364 (2000).

Financial Times, Dec. 21, 2000, p. 12.

Abbott, et al. "J. Electroanal. Chem" vol. 347, pp. 153-164 (1993).

Cardarelli, et al. "*Tantalum Protective Thin Coating Techniques for the Chemical Process Industry: Molten Salts Electrocoating as New Alternative*" Int. J. Refractory Metals & Hard Materials, vol. 14, pp. 365-381 (1996).

Delimarskii, et al. "Electrochemistry of Fused Salts—Molten Salt Techniques" vol. 2, Plenum Press, New York, pp. 138-220, 1961.

Lanelme, et al. "*Electrochemistry-I, Molten Salt Techniques*," vol. 2, Plenum Proess, New York, pp. 138-220, 1984.

Leone, et al. "*High-purity titanium electrowon from titanium tetrachloride*" J.O.M., vol. 19, pp. 18-23 (1967).

Couch, et al. "*Evaluation of diaphragm materials for electrowinning high-purity titanium*" Proc. Extractive Met. Div. Symp., Met. Soc. AIME, Chicago, IL., pp. 309-323, Dec. 11-13, 1967.

Leone, et al. "*Use of composite diaphragms in the electrowinning of titanium*" Report Investigation #7648, U.S Dept. of Interior, Bureau of Mines, Washington, 1972.

Priscu, J.C. "*Symp. on Electrometallurgy, Proc. AIME Extractive Metallurgy Div.*" Cleveland, Ohio, p. 83, Dec. 1968.

Hashimoto, et al. "*Electrowinning of titanium from its oxides, Part I., Fused Salt Eletrolysis at Temperatures above the melting point of Metal*" Denki Kagaku, vol. 39, pp. 516-522, (1971).

Hashimoto, et al. "*Electrowinning of titanium from its oxides, Part II., Influences of Fluoride Salt Baths on Fused-Salt Electrodeposition of Titanium Metal from Titanium Dioxide*" Denki Kagaku, vol. 39, pp. 938-943, (1971).

Nakamura, et al. "*Electrochemical Deoxidation of Titanium*", Proc. Electrodhem. Soc. Molten Salt Chemistry and Technology, pp. 93-99 (1993).

Okabe, et al. "*Metall. Trans. B*" 24B, pp. 449-455 (1993).

Okabe, et al. "*J. Alloys Compounds*" 282, pp. 155-164 (1996).

Pal, et al. "*Emerging SOM Technology for the Green Sysnthesis of Metals from Oxides*", J.O.M. pp. 32-35, Oct. 2001.

Andersson, et al. "Acta Chem Scan" vol. 11, pp. 1641 (1957).

Cardarelli, "*Materials Handbook: A Concise Desktop Reference*", pp. 329-330, Springer-Verlag, London Ltd., (2001).

Clarke, et al. "*Applications of Ebonex® Conductive Ceramic Electrodes in Effluent Treatment*" Electrochemistry for a Cleaner Environment, East Amhert, N.Y., pp. 349-363 (1992).

ASTM B299-99—*Standard Specification for Titanium Sponge*, American society for Testing and Materials, Jul. 1999.

* cited by examiner 10
18
18
consumable carbon anode (+)
26
28
Water cooled flanges
Slide gate valves
14
$CO_2$(gas)
$CO_2$(gas)
$CO_2$(gas)
$CO_2$(gas)
Argon atmosphere
16
Molten salt electrolyte
12
Protective frozen layers (banks)
Molten titania slag cathode (-)
24
Liquid titanium metal or Ti-alloy (-)
Taphole
32
30

10
20
20
inert dimensionally stable anode (+)
26
28
Water cooled flanges
Slide gate valves
14
$O_2$(gas)
$O_2$(gas)
$O_2$(gas)
$O_2$(gas)
Argon atmosphere
16
Molten salt electrolyte
12
Protective frozen layers (banks)
Molten titania slag cathode (-)
24
Liquid titanium metal or Ti-alloy (-)
Taphole
32
30

10
Solid state oxygen ion conductor (solid electrolyte)
Natural gas or melter gas (CO + H2)
22
CO2(gas)
CO2(gas)
22
Gas diffusion anode (+)
26
Water cooled flanges
28
Slide gate valves
Argon atmosphere
12
Protective frozen layers (banks)
Molten titania slag cathode (-)
24
Liquid titanium metal or Ti-alloy (-)
Taphole
32
30

METHOD FOR ELECTROWINNING OF TITANIUM METAL OR ALLOY FROM TITANIUM OXIDE CONTAINING COMPOUND IN THE LIQUID STATE

FIELD OF THE INVENTION

This invention relates to a method for the continuous electrowinning of titanium metal or titanium alloys from electrically conductive titanium oxide containing compounds in the liquid state such as molten titania slag, molten ilmenite, molten leucoxene, molten perowskite, molten titanite, and molten natural or synthetic rutile.

BACKGROUND ART

Titanium metal has been produced and manufactured on a commercial scale since the early 1950s for its unique set of properties: (i) high strength-to-weight ratio, (ii) elevated melting point, and (iii) excellent corrosion resistance in various harsh chemical environments[1]. Actually, about 55% of titanium metal produced worldwide is used as structural metal in civilian and military aircraft and spacecraft such as jet engines, airframes components, and space and missile applications[2]. Titanium metal is also employed in the chemical process industries (30%), sporting and consumer goods (14%), and in a lesser extend power generation, marine, ordnance, architecture, and medical[3]. Titanium sponge, the primary metal form during titanium production is still produced industrially worldwide by a process invented by Dr. Wilhelm Justin Kroll[4] and patented in the 1940s[5]. The Kroll Process consists to the metallothermic reduction of gaseous titanium tetrachloride with pure magnesium metal. However, today potential huge market such as automotive parts are still looking forward to seeing the cost of the primary metal to decrease by 50-70%. Nevertheless, this cost is only maintained high due to the expensive steps used to win the metal. Even if the Kroll's process has been improved since its first industrial introduction it still exhibits several drawbacks: (1) it is performed under strictly batch conditions leading to expensive downtimes, (2) the inefficient contact between reactants leads to slow reaction kinetics, (3) it requires the preparation, purification, and use the volatile and corrosive titanium tetrachloride ($TiCl_4$) as the dominant feed with its associated health and safety issues, (4) the process can only accept expensive natural rutile or rutile substitutes (e.g., upgraded titania slag, synthetic rutile) as raw materials, (5) the magnesium and chlorine must be recovered from reaction products by electrolysis in molten salts accounting for 6% of the final cost of the sponge, (6) the specification of low residual oxygen and iron content of the final ingot requires expensive and complex refinning steps (e.g., vacuum distillation, and/or acid leaching) of the crude titanium sponge in order to remove entrapped inclusions accounting for about 30% of the final cost of the ingot, finally (7) it only produces dendritic crystals or powder requiring extensive reprocessing before usable mill products can be obtained (i.e., remelting, casting, forging) and wastage of 50% is common in fabricating titanium parts.

For all the above reasons, since the early 1970s there is a strong commitment of the titanium industry in synergy with several academic institutes to actively pursue new routes for producing titanium metal. Research and development focus has been directed towards developing a continuous process to produce high-purity and low-cost titanium powder or ingots for metallurgical applications.

Although a plethora of alternative methods have been examined beyond a laboratory stage or have been considered for preparing titanium crystals, sponge, powder, and alloys, none have reached industrial production.

Included in those known processes were: (i) gaseous and plasma reduction, (ii) tetraiodide decomposition, (iii) calcio- and aluminothermic reduction, (iv) disproportionation of $TiCl_3$ and $TiCl_2$, (v) carbothermic reduction, and (vi) electrowinning in molten salts. Most were considered by the authoring National Materials Advisory Board committee (NMAB)[6] panel to be unlikely to progress to production in the near future except electrowinning which seemed to be the most promising alternative route.

Actually, the extraction and preparation of pure metals from ores using an electrolytic process is well known as electrowinning. This relatively straightforward process is based on the electrochemical reduction of metal cations present in a suitable electrolyte by electrons supplied by a negative electrode (i.e., cathode, −), while at the positive electrode (i.e., anode, +) an oxidation reaction occurs (e.g., anode dissolution, gas evolution, etc.). According to the first Faraday's law of electrolysis the mass of electrodeposited metal is a direct function of quantity of electricity passed. Today among the current industrial electrolytic processes several utilize an aqueous electrolyte to electrodeposit metal (e.g., Cu, Zn, Ni, Pb, Au).

Unfortunately, aqueous electrolytes exhibit a narrow electrochemical span and are unsuitable for preparing highly electropositive and reactive metals such as titanium.

Actually, when cathodic (i.e., negative) potentials are applied to the electrode, the competitive process of the electrochemical reduction of protons occurs together with the evolution of hydrogen gas. This main parasitic reaction consumes the major part of the reduction current thereby drastically decreasing the overall current efficiency.

Despite the availability of cathode materials exhibiting a large hydrogen evolution overpotential (e.g., Cd, Hg, Pb), it has heretofore been quite impossible to electrodeposit efficiently such metals despite numerous attempts reported in the literature[7 8 9 10 11].

Organic electrolytes were also tested[12 13 14] but despite their wide decomposition potential limits, organic solvents in which an appropriate supporting electrolyte has been dissolved have not yet been used industrially owing to their poor electrical conductivity which increases ohmic drop between electrode gap, the low solubility of inorganic salts, their elevated cost and toxicity.

By contrast, molten salt based electrolytes were already used industrially since the beginning of the 1900s in the electrolytic preparation of important structural metals (e.g., Al, Mg), and in a lesser extent for the preparation of alkali and alkali-earth metals (e.g., Na, Li, and Be).

Actually, fused inorganic salts exhibit numerous attractive features[15 16 17] over aqueous electrolytes, these advantages are as follows: (1) they produce ionic liquids having a wide electrochemical span between decomposition limits (i.e., high decomposition potential) allowing the electrodeposition of highly electropositive metals such as titanium. (2) Based on the Arrhenius law, the high temperature required to melt the inorganic salt promotes fast electrochemical reaction kinetics suitable to increase hourly yields. (3) The faradaic efficiencies are usually close to 100%. (4) Due to their ionic state molten salts possess a high electrical ionic conductivity which minimizes the ohmic-drop and induces lower energy consumption. (5) The elevated solubility of electroactive species in the bath allows to utilize high solute concentrations allowing to operate at high cathodic current densities.

Therefore, it has become clear that the most promising route for electrowinning titanium is to develop a high temperature electrolytic process conducted in molten salt electrolytes. However, despite the numerous attempts performed until today there are still no available electrolytic processes in molten salts for producing titanium metal industrially. In order to reach industrial success the new electrochemical route must solve the major issues of the energy demanding and labor intensive Kroll's process and also overcome the pitfalls that have lead to failures until today.

Actually, the electrolytic production of titanium metal has been extensively investigated with the aim of developing a continuous process to replace Kroll's process. Several attempts were made in industry.

Early work was done since 1950 by National Lead Industries, Inc. and in 1956 at the former U.S. Bureau of Mines (USBM) in Boulder City, Nev. A small pilot was built to investigate the electrowinning of titanium[18] It consisted of a 12-inch cylinder vessel lined with pure iron and containing a molten electrolyte made of a mixture of LiCl—KCl approximately at the eutectic composition with $TiCl_2$ added. Three equally spaced openings in the cell top accommodated: (i) the replaceable anode assembly, (ii) the titanium tetrachloride feed unit, and (iii) the cathode. Three slide valves combined with air-locks allowed the quick and easy introduction or removal of assemblies without contaminating the cell. The desired solute (i.e., $TiCl_2$) was produced in-situ either by the chemical reduction of stoichiometric amount of $TiCl_4$ with titanium metal scrap or by direct electrochemical reduction of $TiCl_4$ at the cathode. Actually, $TiCl_4$, a covalent compound, does not ionize and must be converted to a ionic compound such as $TiCl_2$. The concentration was then increased by operating only the feed cathode and anode and feeding one mole of $TiCl_4$ per two faradays of charge. In all cases gaseous $TiCl_4$ was introduced into the bath close to the cathode with a feed nickel tube plated with molybdenum and dipped below the surface level of the melt. In order to avoid the oxidation of the newly formed $Ti^{2+}$ and dragout of the dissolved $TiCl_4$ with the chlorine evolved at the anode, a porous ceramic diaphragm made of alundum® (i.e., 86 wt. % $Al_2O_3$-12 wt. % $SiO_2$)[19] surrounded the immersed graphite anode forming distinct anolyte and catholyte compartments. The reported optimum operating conditions identified were: (1) an operating temperature above 500° C. to prevent the precipitation of solute, and below 550° C. to avoid severe corrosion of the alundum diaphragm, usually 520° C., (2) a solute content comprises between 2 and 4 wt. % $TiCl_2$, (3) a cathodic current density of 1 to 5 $kA \cdot m^{-2}$, while the anodic current density was comprised between 5 and 10 $kA \cdot m^{-2}$, (4) a diaphragm current density of 1.5 $kA \cdot m^{-2}$. By conducting experiments with the above conditions USBM claimed that high-purity titanium was electrowon with a Brinell hardness as low as 68 HB and a current efficiency of 60%. However frequent failures of the diaphragm that became periodically plugged or loaded with titanium crystals proved troublesome. As the titanium content increased, the ceramic diaphragm became conductive and then acted as a bipolar electrode and had to be removed rapidly from the bath. In 1972, the same authors[20] built a larger rectangular cell containing 226.8 kg (i.e., 500 lb.) of bath in order to assess the actual performance of two kind of diaphragm materials: (i) solid materials composite diaphragms, and (ii) loose fill materials composite diaphragms. For solid diaphragms, it was observed that alundum coated nickel screen showed little deterioration but was subject to the same current density limitations as the porous alundum diaphragm. On the other hand, cement coated nickel screens with loose fill material such as alumina was the best material in terms of strength, flexibility, resistance to corrosion, and low replacement of titanium (0.2 to 1.0 wt. %).

In 1968, Priscu[21] of the Titanium Metal Corporation (TIMET) disclosed that a new electrowinning cell was patented[22], designed and operated in Henderson, Nev. This electrolytic cell was a unique pilot based on a non diaphragm basket cathode type. The cell used a suspended central metal basket cathode with sixteen anodes peripheral to the basket. The central basket cathode was a cubic box with the four sides made of perforated steel plates, while the bottom and top were blind plates. Four steel rods were used in the basket to act as cathode collectors while $TiCl_4$ was fed using a tube positioned at the center of the basket. $TiCl_4$ was initially fed at a low rate into the center of the basket walls. This porous sidewall deposit served as a diaphragm to keep the reduced $TiCl_2$ inside the basket while a mechanical system was provided for withdrawing the large cathode deposits into an inert-gas-filled chamber, installing a new cathode, and reclaiming the inert gas for reuse. The average valence of dissolved titanium cations was maintained very low generally no greater than 2.1 to obtain the electrodeposition of premium-grade titanium metal. TIMET claimed that later models of pilot-plants have produced up to 363 to 408 kg (i.e., 800 to 900 lb.) of titanium metal in one cathode deposit. This semi-works plant produced about 68 tonnes (i.e., 150,000 lb.) of electrolytic titanium sponge but discontinued the operation in 1968 owing of overcapacity for making sponge by Kroll's process.

Later in 1971, Hashimoto et al. have worked extensively on the electrowinning of titanium metal from its oxides or mixed oxides[23 24 25]. Titanium solute was introduced in a molten fluoride bath, as a solid compound such as $TiO_2$, $FeTiO_3$, $CaTiO_3$, or $MgTiO_3$. The melt chemistries tested were $CaF_2$, $MgF_2$, $BaF_2$, NaF and their mixtures. The first electrolysis study was conducted at temperatures above 1600° C. with graphite anode and cathode. Only in the cases of the $CaF_2$—$TiO_2$ (1-10% wt.) and $CaF_2$—$CaTiO_3$ (10% wt.) melt systems molten titanium was obtained but largely contaminated by carbon and oxygen (2-4 wt. %). In other cases, fine titanium powder was only obtained. After the preliminary results, they focussed on the electrowinning of titanium from pure $TiO_2$ carried out in molten salt baths made of $CaF_2$, $BaF_2$, $MgF_2$, $CaF_2$—$MgF_2$, $CaF_2$—NaF, $CaF_2$—$MgF_2$—NaF, $CaF_2$—$MgF_2$—$NaF_2$, and $CaF_2$—$MgF_2$—$SrF_2$ at 1300-1420°. The titanium electrodeposited in $CaF_2$ and $BaF_2$ baths was considerably contaminated by carbon owing to graphite electrodes. In NaF-containing fused salts such as $CaF_2$—NaF and $CaF_2$—$MgF_2$—NaF, only fine powdery deposits were obtained due to simultaneous sodium reduction that occurs. In the baths of $MgF_2$, $CaF_2$—$MgF_2$, $CaF_2$—$MgF_2$—$BaF_2$, and $CaF_2$—$MgF_2$—$SrF_2$, dendritic deposits were obtained. They pointed out that best result was obtained in the $CaF_2$—$MgF_2$ bath, but the purity of the deposit was not as high as that of the common grade titanium sponge required by the industry. In the third article, electrowinning of titanium was carried out in $CaF_2$—$MgF_2$ (50-50 wt. %) molten salt bath at 1020-1030° C. in an argon atmosphere by using a completely enclosed cell. In electrowinning from $TiO_2$, the form of the electrodeposited metal changed from crystaline to spongelike with an increase in current density, or cell voltage, but when $CaTiO_3$ was used, deposits were spongelike. Despite the material yield of titanium was superior to 95 wt. % it did not still meet the requirements of commercial sponge.

Later in 1973, the Dow Chemical Company in a close working relationship with the HOWMET group (i.e., subsidiary of the French Pechiney Ugine Kuhlmann (PUK) Group) founded the D-H Titanium Company for producing continuously high-purity electrolytic titanium at Howmet's plant in Whiteall, Mich.[26]. Cell design, operating procedure, metal quality, proposed production, and economic projections have been described by Cobel et al.[27]. The technology was based on the cell designed in the previous work done at Dow Chemical by Juckniess et al[28]. Actually, a major cell improvement in the D-H Titanium design was the fabrication of a metal screen diaphragm that was electroless-plated with cobalt or nickel to give the required electrical and flow characteristics. The cell operated at 520° C. under argon atmosphere with LiCl—KCl—$TiCl_2$ (ca. 2 wt. % $TiCl_2$) as molten salt electrolyte. $TiCl_4$ was fed continuously into a pre-reduction cathode compartment where reduction to dichloride $TiCl_2$ takes place at a separate feed cathode within the cell. Final reduction to metal was continuously done on separate deposition cathodes. The cathodes were periodically removed hot and placed into a stripping machine under inert atmosphere. Metal-working cathodes were individually pulled, stripped, and replaced in the cell, in an argon atmosphere, by a self-positioning and automatically operated mechanical device. A sealed, argon-shielded hopper containing the titanium crystals and entrained electrode was cooled before being opened to discharge its contents. Crystalline metal and dragout salts were crushed to ⅜-inch size and leached in dilute 0.5 wt. % HCl solution. Then the spent solution was neutralized with a mixture of $Li_2CO_3$ and KOH in a ratio equivalent to that used in the electrolyte. Dragout of electrolyte varied with the titanium crystal sizes to about 1 kg per kg of fine titanium for coarse washed metal. Dragout was dried and passed over a magnetic separator, and metal fines were removed by screening to about 80 mesh (177 μm). They claimed that the sponge produced exhibited both a low residual oxygen, nitrogen, iron and chlorine content, had a Brinell hardness of 60 to 90 HB and excellent melting characteristics. According to Cobel et al.[29], the direct current required for electrowinning (17.4 kWh/kg) appears to be only about half that required for the Kroll process. Although titanium sponge of apparently satisfactory purity was claimed to be produced in relatively small pilot-plant cells with a daily titanium capacity of up to 86 kilograms per day, the electrowinning of titanium was far from an industrial scale.

Unfortunately, in Dec. 30, 1982, according to American Metal Market, the expenses for completing the joint program and the economic climate at that time have forced the dissolution of the D-H Titanium Company. With the breakup each company (i.e., Dow and Howmet) Dow has continued some research and development work on the electrolytic process but without success while Howmet apart having patented some work done in France[30 31] has later focused in the metals fabrication area.

In 1985, the Italian company Elettrochimica Marco Ginatta S.p.A. (EMG) owned by the Italian scientist and businessman Marco Vincenzo Ginatta claimed a new electrowinning process[32] inspired from the previous attempts[33]. This new upgraded process for the electrolytic preparation of titanium uses always the dissolution and cathodic reduction of titanium tetrachloride in an electrolyte made of alkali or alkaline-earth metal halides and the electrodeposition of the dissolved titanium cations. The process was supported by RMI Titanium, and the company built a pilot plant. Ginatta claimed that the current production capacity of this plant reached 70 tonnes per year in 1985[34]. Unfortunately, in 1990 RMI closed the plant owing to inability to solve "engineering issues".

Later, in the period 1997-2000 Kawakami et al.[35] have proposed an electroslag remelting process. The main idea was to avoid common dendritic electrodeposits by producing the electrodeposited titanium metal in its liquid state. Direct electrowinning of liquid titanium metal was the investigated techniques by using a direct current Electro-Slag Remelting (i.e., DC-ESR) apparatus. A small scale DC-ESR unit of 110 mm inner diameter was operated in d.c. reverse polarity mode, where a graphite rod was used as anode and a steel or a copper base-plate was used as cathode. The used slag was CaO—$CaF_2$—$TiO_2$ mixture. The current was approximately 1.5 kA. Under certain experimental conditions, some amount of titanium was electrodeposited in the metal pool. From the view point of heat balance, the sufficient heat was supplied by Joule heating in a molten slag phase. It can be seen from the published results that unfortunately most of the deposit was obtained as TiC and the current efficiency for the reduction was only 1.5%.

In 1999, the process was improved[36], the current efficiency for the reduction was up to 18% with a larger distance between the electrodes. Some amount of titanium was electrodeposited on the base-plate though its state changed with the electrolytic condition. Pure titanium metal pieces were obtained in the solidified salt after the run with the bigger electrode distance. It was concluded that the electrowinning of liquid titanium metal by the present process was possible if sufficient heat to form a metal pool can be supplied at the bigger distance between the electrodes. The DC-ESR process was patented in 1988 and reconducted in 2000, and then recently presented at ECS meeting[37].

The idea to use a molten pool of titanium was also recently claimed by Ginatta Torino Technology (GTT) who patented a new process for electrowinning titanium based on the recovery of the molten metal using a pool of liquid titanium as cathode like for aluminium[38].

The main idea of Ginatta is to avoid common dendritic electrodeposits by producing the electrodeposited titanium metal in the liquid state such as for aluminium. Nevertheless, the process which operates at 1750° C. still needs to convert the expensive titanium dioxide to the titanium tetrachloride and the dissolution of the feedstock into a molten salt electrolyte made of $CaCl_2$—$CaF_2$ and containing calcium metal Ca.

Recently in 2000, based on early results obtained by Fray, Farthing, and Chen[39 40] at the Dept. of Materials Science of the Cambridge University, early trials were conducted and patented[41 42] at the Defence Evaluation and Research Agency (DERA) at Farnborough (Hampshire, U.K.). A new company British Titanium (BTi) has been formed to commercialize the newly discovered process[43] that the scientific litterature has dubbed the Cambridge's or FFC's Process. The process claims the electrochemical deoxidation of solid titanium dioxide that was originally applied for refining titanium metal by Okabe et al. in 1993[44 45 46]. The inventors have demonstrated at the laboratory scale that the reduction reaction proceeds at 950° C. from a cathode made originally of solid $TiO_2$ while oxidation of oxygen anions occurs at the graphite anode with evolution of carbon dioxide. Pure calcium chloride ($CaCl_2$) was selected as molten salt electrolyte owing to its high solubility for oxygen and excellent migration transport properties for oxygen anions. According to inventors, the process for the production of pure titanium metal consists of the following sequences of operations. The pure titanium dioxide powder is mixed with an appropriate binder to form a past or slip, and cast into a rectangular shape cathodes using one of the techniques common in the ceramic industry, such as rolling or slip casting. The green cathode will be then fired in an air kiln to initiate sintering in order to produce a solid ceramic material. After sintering the shapes give solid cathodes. Reduction of titanium occurs in an enclosed electrolytic cell with inert gas filling. The cell is designed for continuous operation with cathodes at different stages in their cycles being inserted and removed through an automated air lock. By controlling the cathode potential, oxygen can be removed from titanium dioxide allowing to leave behind a high purity metal which is morphologically similar to the Kroll's sponge. The cell voltage is roughly 3 V, which is just below the decomposition voltage of $CaCl_2$ (3.25 V at 950° C.), avoiding chlorine evolution at the anode but Well above the decomposition voltage of $TiO_2$ (1.85 V at 950° C.). Sufficient overpotential is necessary to reduce the oxygen content of the titanium metal. The inventors claim that stoichiometric mixture of other metal oxides with $TiO_2$ into the original cathode are also concurrently reduced to metal leading to the possibility to produce also titanium alloys although the microstructure is different. The process has been demonstrated in a bench-scale reactor (i.e., 1 kilogram per day). The Cambridge's process claimed that it overcomes several of the issues encountered by its predecessors but however there are several important pitfalls to be overcome in scaling-up the process for a future commercial development. Primarily, it has an extremely low space time yield, i.e., mass of titanium produced per unit time and cathode surface area. This is related to the slow diffusion kinetics of oxygen across the layer of solid titanium metal at the cathode/electrolyte interface. Actually, several hours are required to completely reduce a porous pellet made of sintered $TiO_2$ and huge cathode surface areas are needed to compensate. Secondly, since the waste $CaCl_2$ can be only removed from the titanium by water leaching after the completion of the reaction it is strictly a batch process. Finally, it requires expensive preparation of titanium dioxide pellets as feedstock itself produced from tetrachloride and a preliminary preparation to render the feedstock conductive is needed.

Also in 2000, Sharma[47] proposed the calciothermic reduction of pure titanium dioxide with a zinc-calcium alloys performed in a molten salt mixture of $CaCl_2$—$CaF_2$ at 800° C. Titanium powder was later recovered from the Zn—Ti alloys formed by vacuum distillation which is highly energy demanding.

In 2001, Fortin[48] proposed another process for obtaining titanium metal from ilmenite using a so-called 'shuttle-alloys'. The process which comprises two consecutive steps requires expensive materials and some having environmental issues for an industrial process and is also energy demanding.

In 2001, Pal et al. from Boston University suggested a new way for electrowinning reactive metals including titanium using a solid oxide membrane (SOM) process[49]. The patented method consists to electrolyse a molten salt electrolyte containing the cations of the metal to electrodeposit at the cathode using a porous gas diffusion anode separated from the high temperature melt by a solid ionic membrane capable of transporting the anionic species of the electrolyte to the anode[50 51]. Nevertheless, this process did not use the electrochemical deoxidation of a cathode and no mentions is made to use SOM as a unique electrolyte immersed into a molten titania slag acting as liquid cathode material.

Heretofore, no processes described in the prior art have proven to be satisfactory or gained industrial acceptance. None of the prior art processes directly use inexpensive titanium feedstocks such as crude titania slag for producing electrochemically titanium metal and alloys. Actually, plenty of crude titania slag is produced industrially by the carbothermic reduction of hemo-ilmenite or ilmenite ore concentrate with anthracite coal into an electric arc furnace (EAF) such as those produced industrially by Québec Iron & Titanium Inc. (QIT) in Canada or by Richards Bay Minerals in South Africa. Indeed, titania slag exhibits a semiconductive behavior and hence it can be used without any treatment and additives as an electrode material. Its good electronic conductivity ranging from 10 $S \cdot m^{-1}$ for the bulk solid at room temperature until $1.21 \times 10^4$ $S \cdot m^{-1}$ for the melt above its liquidus temperature is related to the sub-stoichiometric titanium oxides it contains. These oxides exhibit the typical Andersson-Magneli crystal structure[52] having the global chemical formula $Ti_nO_{2n-1}$, with n an integer at least equal to 4 (e.g., $Ti_4O_7$, $Ti_5O_9$, $Ti_6O_{11}$). Actually, these oxides exhibit in their pure state at room temperature an electrical resistivity sometimes even lower than that of pure graphite (e.g., as low as 630μΩ·cm for $Ti_4O_7$).

Highly pure form of these titanium oxides were first suggested as electrode material by Hayfield[53] from IMI and are now produced and commercialized under the trade name Ebonex®[54] by the British company Atraverda Ltd.[55].

First experimental trials performed at RTIT to deoxidize electrochemically solid titania slag with calcium chloride as electrolyte at 950° C. indicated that the process works but only produces a thin and brittle layer of titanium-iron alloy at the slag/electrolyte interface. The overall electrochemical reaction corresponds to the carbothermic reduction of titanium dioxide with the following reaction scheme:

$$TiO_2(sol.)+C(sol.)=Ti(sol.)\downarrow+CO_2(gas)\uparrow$$

The experimental results demonstrated that the electrochemical reaction exhibits both an extraordinarily high specific energy consumption and extremely low space time yield. These poor performances were attributed mainly to the newly formed titanium metal layer at the slag/electrolyte interface that impedes proper mass transfer by diffusion of oxygen anions. In other words, as soon as a thin layer of solid titanium is produced, the process is "choked" and proceeds little further. Deoxidizing at higher temperatures up to 1350° C. was also achieved but despite improved performance the process remained unsatisfactory for a profitable industrial process.

Thus, there remains an important need for an improved deoxidizing process for titanium oxide containing compounds.

SUMMARY OF THE INVENTION

In general terms, the present invention provides an improved deoxidizing process for titanium oxide containing compounds. Thus, the present invention, provides a method for electrowinning of titanium metal or titanium alloys from conductive titanium oxide containing compounds selected from titanium oxides, ferro-titanium oxides, titanium compounds and mixtures thereof. The method comprising the steps of:

(a) providing the conductive titanium oxide containing compound at temperatures corresponding to the liquid state so as to provide a molten material;

(b) pouring the molten material into an electrochemical reactor to form a pool of electrically conductive liquid acting as molten cathode material;

(c) covering the molten cathode material with a layer of electrolyte, preferably molten salts or a solid state ionic conductor hence providing an interface between the molten cathode material and the electrolyte;

(d) providing at least one anode in said electrolyte, said anode(s) being operatively connected to an electrical current source;

(e) deoxidizing electrochemically the molten cathode at the interface with the electrolyte by electrolysis induced by said current source and circulating between the anode and cathode;

(f) recovering the resulting deoxidized titanium metal or titanium alloy.

In another related embodiment, the method comprises the steps of:

(a) providing the conductive titanium oxide containing compound at temperatures corresponding to the liquid state so as to provide a molten material to be used as a molten cathode material;

(b) providing a molten electrolyte, preferably molten salts or a solid state ionic conductor in an electrochemical reactor;

(c) pouring the molten cathode material into said electrolyte and allowing separation based on relative densities with settling of the molten cathode material as a layer under the molten electrolyte, hence providing a clean interface between the molten cathode material and the electrolyte;

(d) providing at least one anode in said electrolyte, said anode(s) being operatively connected to an electrical current source;

(e) deoxidizing electrochemically the molten cathode at the interface with the electrolyte by electrolysis induced by said current source and circulating between the anode and cathode;

(f) recovering the resulting deoxidized titanium metal or titanium ally.

In another related embodiment, the electrolyte is not molten and is simply part of a gas diffusion anode(s) which is dipped in the molten cathode of titanium oxide containing compounds.

In a preferred embodiment, the method is conducted as part of a continuous process.

DETAILED DESCRIPTION OF PREFERRED EMBODIMENTS FOR CARRYING OUT THE INVENTION

Generally speaking, this invention relates to a method for the electrowinning of titanium metal or its alloys from electrically conductive titanium mixed oxide compounds in the liquid state such as molten titania slag, molten ilmenite, molten perowskite, molten leucoxene, molten titanite, and molten natural or synthetic rutile.

Figure 1:
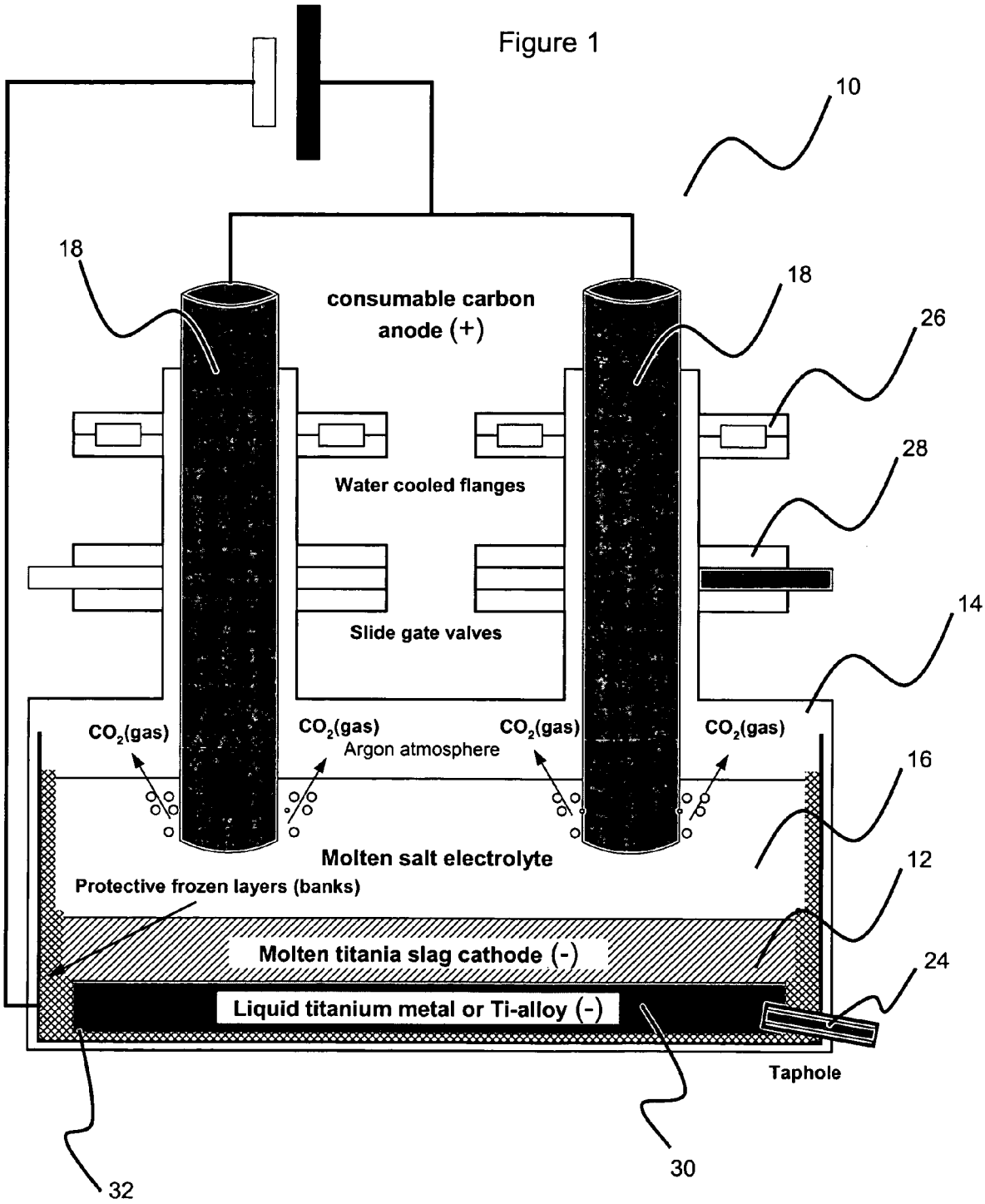
FIG. 1 is a schematic illustration of the electrochemical reactor with a molten salt electrolyte and a consumable carbon anode.
Figure 2:
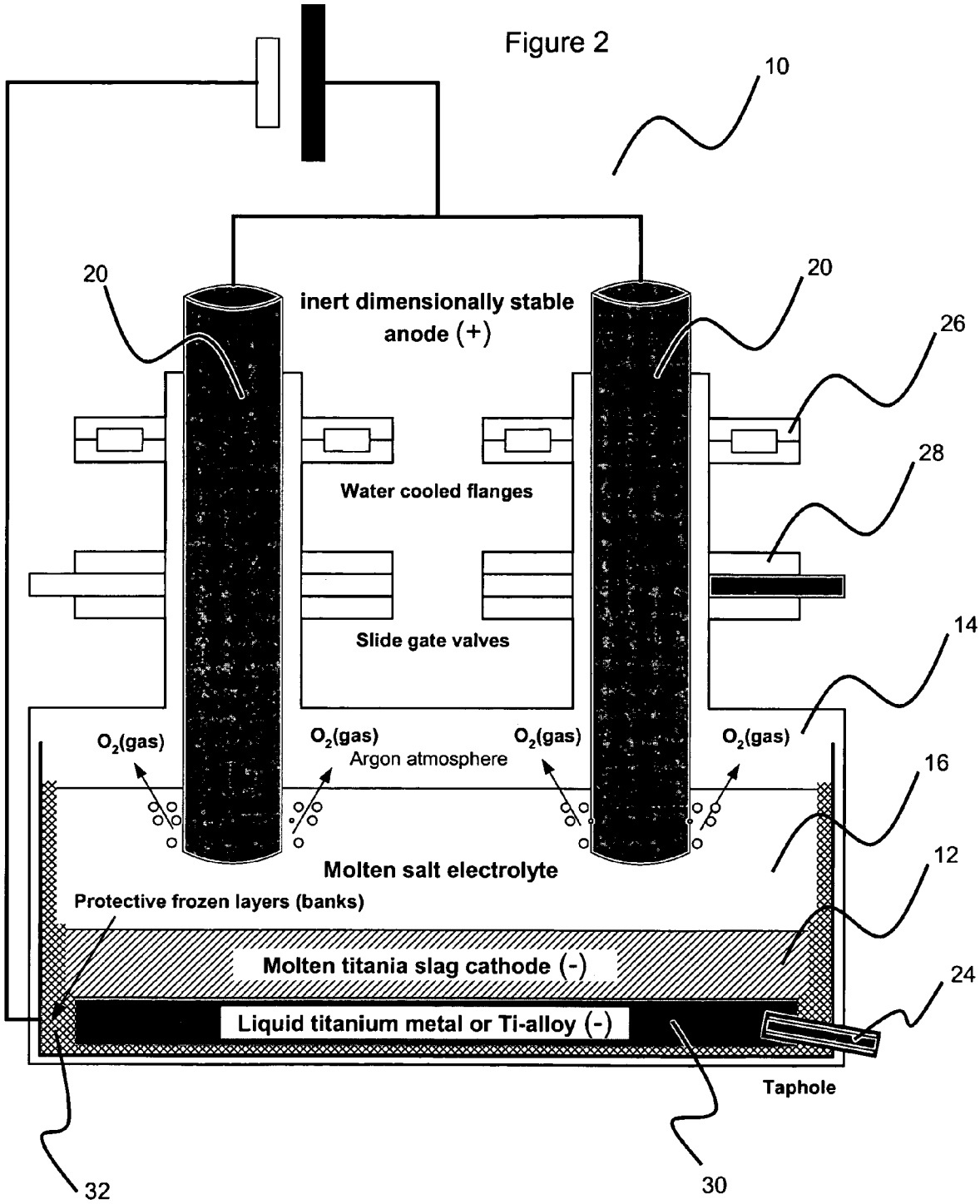
FIG. 2 is a schematic illustration of the electrochemical reactor with a molten salt electrolyte and an inert dimensionally stable anode.
Figure 3:
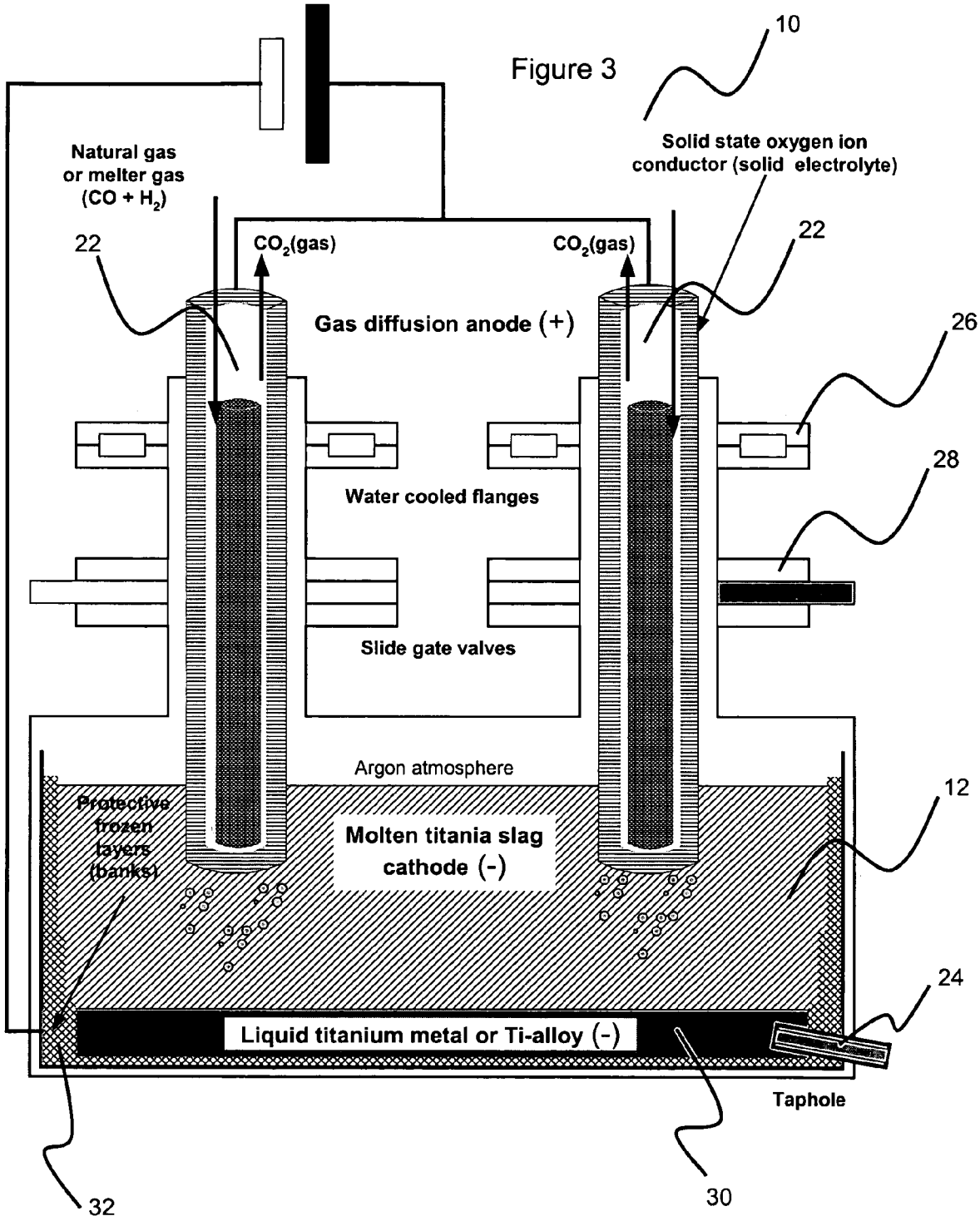
FIG. 3 is a schematic illustration of the electrochemical reactor with a solid oxygen anion conductor electrolyte and a gas diffusion anode.

Referring to FIGS. 1-3 there is shown an apparatus (10) for conducting the method of the present invention. The apparatus shown in FIGS. 1-3 only differ in the choice of anodes. The method preferably involves tapping by gravity or by siphoning the crude and molten titanium slag (12) directly from an operating electric arc furnace currently used for the smelting of hemo-ilmenite or ilmenite ore with anthracite coal. Pouring the molten titania slag at the bottom of an electrolytic cell (14) to form a pool acting as liquid cathode material (−) (12). The liquid cathode (12) is covered with a layer of molten salt electrolyte (16) such as molten calcium fluoride (i.e., fluorspar) or a solid-state oxygen ion conductor (e.g., yttria stabilized zirconia, beta-alumina). Reducing cathodically by direct current electrolysis at high temperatures the molten titania slag with either at least one of a consumable carbon anode (18), an inert dimensionally stable anode shown as numeral (20) on FIG. 2 or a gas diffusion anode fed with a combustible gas (+) shown as numeral (22) on FIG. 3. The electrochemical deoxidation initially produces droplets of metallic impurities such as metallic iron and other transition metals more noble than titanium (e.g., Mn, Cr, V, etc.). Hence iron metal and other metals droplets sink by gravity settling to the bottom of the electrolytic cell forming a pool of liquid metal while oxygen anions diffuse and migrate through the molten salt electrolyte to the anode(s). In the case of a consumable carbon anode carbon dioxide gas is evolved at the anode. Once all the iron and other metals are removed electrolitically the pool is siphoned or tapped at the taphole (24). The apparatus (10) is provided with water cooled flanges (26) and slide gate valves (28) to permit removal and insertion of materials without electrolytic cell contamination.

Once the first deoxidized metals or alloys are removed, then the temperature of the melt is increased by Joule's heating to compensate the concentration in titania content. Then droplets of liquid titanium metal are electrodeposited at the slag/electrolyte interface while oxygen anions diffuse and migrate through the electrolyte to the anode(s). Owing to the higher density of the liquid titanium compared to that of the molten titania slag, the liquid titanium droplets sink by gravity settling to the bottom of the electrolytic cell forming after coalescence a pool of pure liquid titanium metal (30). The pure liquid titanium metal is continuously tapped by gravity or siphoning under an inert atmosphere and cast into a dense, coherent, and large ingots.

The first and optional step consists in tapping or siphoning crude molten titanium slag directly from an operating electric arc furnace (EAF) currently used for the smelting of hemo-ilmenite or ilmenite ore concentrate with anthracite coal. Transferring the hot molten liquid to an electrochemical reactor using techniques well known in the metallurgical industry (e.g., tapholes, slidegates). The transfer is intented to keep the sensible and latent heat of the molten titania slag unchanged in order to maintain energy consumption lower as possible without the need of melting it again. The temperature of molten titania slag usually ranges between 1570° C. to 1860° C. depending on its titania content which is usually comprised between 77 to 85 wt. % $TiO_2$ for crude titania slags and until 92-96 wt. % for melts made of upgraded titania slag, natural or syntetic rutile.

Preferably, the molten titania slag is flowed into a furnace that already contains an electrolyte made of molten inorganic salts or their mixtures such as alkali-earth metals halides, but more preferably alkali-earth metals chlorides or fluorides with a final preference for metallurgical grade fluorspar (i.e., fluorite or calcium fluoride $CaF_2$).

In a preferred embodiment, the electrolytic cell (14) which is designed for continuous operation consists of a high temperature furnace with consumable carbon anodes (18) or inert dimensionally anodes (20) or gas diffusion anodes (22) that can be inserted and removed from the electrochemical reactor at different stages in their cycles without any entries of air and moisture through tight air locks which are closed by means of large gate valves (28). The refractory walls are water-cooled externally (32) in order to maintain a thick and protective frozen layer (banks) of both titanium metal, titania slag and electrolyte. This is done to self-contain this ternary system at high temperature and avoid any corrosion issues. During electrolysis, heat is only provided to the electrochemical reactor by Joule's heating. The electrolysis is performed under galvanostatic conditions (i.e., at constant current) by imposing a direct current between the molten titania slag cathode (−) and the anode (+) by mean of an d.c. electric power supply or a rectifier. Usually high cathodic current densities of 5 $kA \cdot m^{-2}$ are imposed with a cell voltage of less than 3 volts. Owing to the high operating temperature which is above the melting point of titanium metal (1660° C.) and the higher density of pure liquid titanium (4082 $kg.m^{-3}$) compared to that of the molten titania slag (3510 $kg.m^{-3}$), the electrodeposited titanium at the slag/electrolyte interface forms droplets of liquid metal that sink by gravity settling at the bottom of the electrolytic cell forming a pool of pure liquid titanium metal. The pool also acts as an efficient current collector and never impedes the oxygen diffusion at the slag electrolyte interface. While oxygen anions removed from the titania diffuse and migrate to the carbon anode where carbon dioxide is evolved. The overall electrochemical reaction corresponds to the carbothermic reduction of titanium dioxide with an overall reaction scheme which is given by:

$$TiO_2\ (liq.)+C(sol.)=Ti\ (liq)\downarrow+CO_2\ (gas)\uparrow$$

The level of molten titanium slag in the electrolytic cell is permanently adjusted in order to insure continuous operating electrolysis. The liquid titanium metal is continuously tapped under an inert argon atmosphere and cast into large dense, and coherent titanium ingots. The titanium metal ingots produced exhibited a high purity and other characteristics that satisfies at least the grade EL-110 in accordance with the standard B299-99 from the American Society for Testing Materials (ASTM)[56] such as a low residual oxygen, nitrogen, iron and chlorine content, a Brinell hardness of 60 HB. The electrowinning process always exhibits a specific energy consumption lower than 7 kWh per kg of titanium metal produced.

Therefore, the present invention resolves many if not all of the previous issues related to the electrolytic production of the titanium metal by: (1) Deoxidizing electrochemically, continuously and in one step a raw and electrically conductive titanium mixed oxide compound such as crude titania slag far less expensive than previous feedstocks such as titanium tetrachloride or pure titanium dioxide. (2) Using the molten titania slag as cathode material, preferably as is, without any prior treatment or introduction of additives. (3) taking advantage of the elevated sensible and latent heat of the molten titania slag because it is can be siphoned directly from an electric arc furnace used industrially for the smelting of ilmenite. (4) Operating the electrolysis at a temperature greater than the liquidus temperature of titania slag and melting point of titanium metal allowing to collect quickly by gravity settling the droplets of electrodeposited titanium as a pool of liquid metal at the bottom of the electrolytic cell below molten titania slag owing the difference of densities. (5) Utilizing high temperature electrolytes with elevated boiling points which are excellent oxygen anions carrier such as molten halide salts (e.g., calcium fluoride, strontium chloride) or solid-state oxygen anion conductors (e.g., yttria-stabilized zirconia, beta alumina). (6) Cooling externally the walls of the electrochemical reactor in order to maintain a protective frozen layer of both titanium metal, titania slag and electrolyte. This is done to self-contain the ternary system at high temperature and prevent potential corrosion issues. During electrolysis, the heat necessary to maintain the melt liquid is preferably only provided by Joule's heating. (7) Using either a consumable carbon electrode or a soluble anode, for example made of electrically conductive titanium compounds such as titanium oxides, carbides, silicides, borides, nitrides and mixtures thereof, or an inert dimensionally stable anode or a gas diffusion electrode fed with a combustible gas such as hydrogen, hydrocarbons, natural gas, ammonia, carbon monoxide or process smelter gas (i.e., carbon monoxide and hydrogen mixtures). (8) Continuously siphoning or tapping of the pure liquid titanium metal and casting it under inert atmosphere into large titanium ingots.

EXAMPLES

Example 1

Reference Example

This example is only intended to provide the performances of the electrochemical deoxidation of solid titania slag. This in order to serve as reference experiment to allow later comparison with the performances of the present invention. For instance, a mass of 0.100 kg of crude titanium slag from Richards Bay Minerals (see Table 1) with at least 85 wt. % $TiO_2$ is crushed and ground to a final particle size comprised between 0.075 mm and 0.420 mm (i.e., 40 and 200 mesh Tyler). This step is required at the laboratory scale only in order to facilitate the removal of inert minerals present in the crude titania slag (e.g., silicates, sulfides) and facilitate the removal of associated chemical impurities (e.g., Fe, Si, Ca, Mg). Secondly, the finely ground titania slag undergoes a magnetic separation step. The strong ferromagnetic phases such as for instance free metallic iron entrapped in the titania slag during the smelting process and its intimately bound silicate minerals are efficiently removed using a low magnetic induction of 0.3 tesla and separated with the magnetic fraction which is discarded. Then the remaining material undergoes a second magnetic separation conducted with a stronger magnetic induction of 1 tesla. The non magnetic fraction containing all the diamagnetic mineral phases (e.g., free silica and silicates) is also discarded. The remaining material consists of a finely purified ground titania slag. Thirdly, the ground material is poured into a pure molybdenum crucible of 5.08 cm inside diameter and 10.16 cm tall and introduced in a high temperature furnace with a graphite heating element. The furnace chamber is closed by means of water cooled flanges, the proper tightness is insured by o-ring gaskets made of fluoroelastomers (e.g., Viton®) or annealed ductile metals (e.g., Cu, Au). The components of the apparatus were selected to achieve a vacuum tight cell at elevated temperatures. Before reaching the temperature of 1200° C., the furnace is purged from background contaminants by medium vacuum pumping (i.e., 0.01 mbar). When the temperature is reached the vacuum circuit was switched to a pure argon stream. The argon stream is purified by passing it through both a water and oxygen traps (i.e., getter made of zirconium turnings heated at 900° C.). Then the temperature is increased to 1700° C. and maintained steady during about 1 hour. Once totally molten the titania slag is cooled down inside the crucible. After complete solidification the typical electrical resistivity of the material at room temperature currently ranges between 600 and 5000 $\mu\Omega \cdot cm$. An inorganic salt consisting of 0.200 kg of pure calcium chloride ($CaCl_2$) is then added and serves as electrolytic bath. Once again, the furnace is tightly closed and heated under medium vacuum until the temperature of fusion of the pure calcium chloride is reached (i.e., 775° C.). At that point the vacuum circuit was switched to a pure argon stream and the temperature is increased until the final operating temperature of 950° C. Then a 1.905 cm diameter rod of consumable carbon anode (e.g., semi-graphite from SGL Carbon) is immersed into the electrolyte with an inter-electrode spacing of 1.5 cm from the titania slag. Once thermal equilibrium is reached, the electrolysis is performed under galvanostatic conditions (i.e., at constant current) by imposing a direct current between the consumable carbon anode (+) and the solid titania slag cathode (−) by mean of a DC electric power supply. A progressive cathodic current ramp of 0.5 $kA \cdot m^{-2} \cdot min^{-1}$ is applied up to a final steady cathodic current density of 5 $kA \cdot m^{-2}$. During this electrolysis the average cell voltage is less than 4.0 volts. At the slag/electrolyte interface the electrochemical deoxidation produce a solid layer of titanium alloy. While the oxygen anions removed from the titania diffuse extremely slowly through this layer and migrate across electrolyte to the carbon anode where carbon dioxide is finally evolved. The overall electrochemical reaction corresponds to the carbothermic reduction of titanium dioxide and overall reaction scheme is given by:

$$TiO_2(sol.)+C(sol.)=Ti(sol.)+CO_2(gas)\uparrow$$

After completion of the reaction, that is, when an anode effect occurs owing to depletion of oxygen anions in the bath, the crucible is cooled down and the calcium chloride is removed easily by washing it with hot water. The surface of the titania slag exposed to the melt revealed a thin metallic layer of few millimeters thickness mainly composed of a titanium alloy with the average chemical composition:

69 wt. % Ti,
25 wt. % Fe,
2.5 wt. % Mn,
2.0 wt. % Cr,
1.5 wt. % Si.

Below this metallic layer it is possible to identify from top to bottom discoloured underlying layers from bluish gray to golden brown and finally dark brown made of various oxygen depleted titania slag regions confirming the progressive deoxidation process. Because the iron and other impurities remain entrapped in the titanium layer, the final purity of the metal is effectively poor and obviously never satisfies the commercial specifications of titanium sponge. Moreover in these conditions the electrowinning process exhibits extremely poor performances (see Table 3) such a huge specific energy consumption of 700 kWh per kg of titanium metal and faradaic efficiency of 0.5% both related to the poor kinetic for diffusion of oxygen anions accross the metallic layer and increased distance from oxygen rich slag.

Example 2

Reference Example

The experimental conditions depicted in the following example just differs from that of the example 1 in that the temperature of electrolysis is now increased to 1100° C. Even in that case, despite electrochemical performances are improved (see Table 3) compared to the previous example with a specific energy consumption of 346 kWh per kilogram of titanium produced and a faradaic efficiency close to 2.4% the final purity of the titanium alloy is quite identical because the feedstock material remained the same.

Example 3

Reference Example

The experimental conditions depicted in the following example just differs from that of the example 1 in that the temperature of electrolysis is now increased to 1350° C. Even in that case, despite electrochemical performances being greatly improved (see Table 3) compared to the previous example with a lower specific energy consumption of 31 kWh per kilogram of titanium produced and a faradaic efficiency close to 13% the final purity of the titanium alloy is quite identical because the feedstock material remained the same.

Example 4

Reference Example

The experimental conditions depicted in the following example just differs from that of the example 3 in that the titania slag is sintered prior to be electrochemically deoxidized. Actually after crushing and sizing the fraction having a particle size of 20/35 mesh (i.e., 425 to 850 μm) is sintered under an argon atmosphere at 1450° C. The solid sintered mass was then used as cathode material in the same set-up devised in the examples 1 and 2. Because the active cathode surface area was enhanced by the sintering process the electrochemical performances are improved with a lower specific energy consumption of 18 kWh per kilogram of titanium produced and a faradaic efficiency close to 36% but the final purity of the titanium alloy is quite still the same because the feedstock material remained the same.

Example 5

The experimental conditions depicted in the following example just differs from that of the example 2 in that (i) the cathode is now molten crude titania slag from Richards Bay Minerals without any prior treatment. (ii) The molten electrolyte is pure molten calcium fluoride ($CaF_2$) and (iii) the electrolysis temperature is 1700° C. During electrolysis the average cell voltage is about 2.0 volts. At the slag/electrolyte interface the electrochemical deoxidation produces in a first step dense droplets of liquid iron metal which is first to be electrodeposited along with other metals more noble than titanium (e.g., Mn, Cr, V, etc.) while oxygen anions diffuse and migrate through the molten salt electrolyte to the carbon anode where carbon dioxide is evolved. The first electrochemical reaction corresponds to the carbothermic reduction of metallic oxides with a reaction scheme given by:

$$M_xO_y(liq.)+(y/2)C(sol.)=xM(liq.)\downarrow+(y/2)CO_2(gas)\uparrow$$

Owing to the higher density of the liquid iron (i.e., 6886 $kg \cdot m^{-3}$ at 1700° C.) and other metals compared to that of the molten titania slag (3510 $kg \cdot m^{-3}$ at 1700° C.), the liquid metal droplets sink quickly by gravity settling at the bottom of the electrolytic cell forming after coalescence a pool of liquid metal which is continuously tapped. Once all the iron and other metallic impurities are removed by this selective electrodeposition, the temperature is increased to 1800° C. to compensate the enhanced content of $TiO_2$ of the purer titania slag. Now electrochemical deoxidation carries on with the electrodeposition of droplets of liquid titanium metal at the slag electrolyte interface. Meanwhile oxygen anions diffuse and migrate through the molten salt electrolyte to the carbon anode where carbon dioxide gas is evolved. Because the molten titania slag has a low dynamic viscosity and exhibits a much lower density (e.g., 3510 $kg \cdot m^{-3}$ for 80 wt. % $TiO_2$ at 1700° C.) than that of pure liquid titanium (e.g., 4082 $kg \cdot m^{-3}$ at 1700° C.), the pure liquid titanium droplets fall by gravity settling at the bottom of the electrolytic cell forming after coalescence a pool of pure liquid titanium metal that accumulate at the bottom of the crucible which is continuously tapped under an inert argon or helium atmosphere. The overall electrochemical reaction corresponds to the carbothermic reduction of titanium dioxide with a reaction scheme given by:

$$TiO_2(liq.)+C(sol.)=Ti(liq.)\downarrow+CO_2(gas)\uparrow$$

Completion of the reaction occurs when an anode effect takes place owing to depletion of oxygen anions in the bath.

The titanium metal small ingot produces exhibits at least 99.9 wt. % Ti and the final purity of the metal always meets the sponge grade EL-110 of standard B299-99 from the American Society for Testing Materials (ASTM)[57]. Moreover electrochemical performances are also greatly improved with a lower specific energy consumption of 6.8 kWh per kilogram of titanium produced and a faradaic efficiency close to 90%.

Example 6

The experimental conditions depicted in the following example just differs from that of the example 5 in that the cathode is now molten crude titania slag with at least 78 wt. % $TiO_2$ such as those produced by Québec Iron & Titanium Inc (e.g., Sorelslag®).

Example 7

The experimental conditions depicted in the following example just differs from that of the example 5 in that the cathode is now molten upgraded titania slag with at least 94 wt. % $TiO_2$ such as those produced by Québec Iron & Titanium Inc (e.g., UGS®).

Example 8

The experimental conditions depicted in the following example just differs from that of the example 5 in that the cathode is now molten synthetic rutile with at least 94 wt. % $TiO_2$ such as those produced artificially in Australia or India from weathered ilmenite and leucoxene, the temperature of electrolysis is 1850° C.

Example 9

The experimental conditions depicted in the following example just differs from that of the example 5 in that the cathode is now molten ACS reagent grade titanium dioxide from Fischer Scientific with at least 99 wt. % $TiO_2$ and the electrolysis temperature is 1860° C.

Example 10

The experimental conditions depicted in the following example just differs from that of the example 4 in that the molten salt electrolyte is replaced by a thick solid-state oxygen anion conductor such as yttria-stabilized zirconia and the anode is a gas diffusion anode feeded with a combustible gas such as either hot natural gas or smelter gas having the volumic composition of 85 vol. % CO and 15 vol. % $H_2$.

Example 11

The experimental conditions depicted in the following example just differs from that of the example 4 in that the molten salt electrolyte is replaced by a thick solid oxygen anion conductor such as beta-alumina and the anode is a gas diffusion anode feeded with a combustible gas such as either hot natural gas or smelter gas having the volumic composition of 85 vol. % CO and 15 vol. % $H_2$.

Description of Electrochemical Quantities Used in the Examples:

Electrochemical Equivalent (Eq):

$$Eq = \frac{n \times F}{v_0 \times M}$$

Faradic (Current) Efficiency ($\epsilon_I$):

$$\varepsilon_I\ (\%) = 100 \times \frac{m}{m_{th}} = 100 \times \frac{m}{i \times \Delta t} \times Eq$$

Electrochemical Conversion Rate (dm/dt):

$$\frac{\partial m}{\partial t} = \left[\frac{v_o M}{nF}\right]\frac{i}{\varepsilon_I} = \frac{i}{\varepsilon_I \cdot Eq}$$

Overall Cell Voltage ($U_{cell}$):

$$U_{cell} = \underbrace{(E_a - E_c)}_{thermodynamic\ cell\ voltage} + \underbrace{\sum_k (\eta_{a,k} - \eta_{c,k})}_{overpotentials} + \underbrace{i\sum_k R_k}_{ohmic\ drops}$$

Specific Energy Consumption ($e_m$):

$$e_m = \frac{\langle U_{cell}\rangle \times \int_o^t i\,dt}{m} = \frac{\overline{U}_{cell} \times i \times \Delta t}{m} = \frac{\overline{U}_{cell} \times Eq}{\varepsilon_I}$$

Space-Time Yield ($Y_t$)

$$Y_t = \frac{\varepsilon_I \times j}{Eq}$$

Energy Efficiency ($\epsilon_E$):

$$\varepsilon_E\ (\%) = 100 \times \left(\frac{U_{Th}}{\overline{U}_{cell}}\right) \times \frac{m \cdot Eq}{i\Delta t} = \varepsilon_U \times \varepsilon_I$$

With the following physical quantities in SI units (in practical units):

Eq electrochemical equivalent in $C \cdot kg^{-1}$ (Ah/kg), n dimensionless number of electrons involved, F Faraday's constant 96485.309 $C \cdot mol^{-1}$ (26.8 Ah/mol), $v_O$ stoichiometric coefficient, M atomic or molar mass of electroactive species in $kg \cdot mol^{-1}$, dm/dt electrochemical conversion rate kg/s (kg/h), $U_{cell}$ average overall cell voltage, in V, $E_{a,c}$ Nernst anodic and cathodic electrode potentials in V, $\eta_{a,c}$ anodic and cathodic overpotentials (e.g., activation, diffusion, passivation), in V, R resistances (e.g., electrodes, electrolyte, busbars, contacts) in Ω, i current intensity, A, m mass of product, in kg, n dimensionless number of electrons involved, $\epsilon_I$ dimensionless faradic or current efficiency, $\epsilon_E$ dimensionless energy efficiency.

TABLE 1

Various feedstocks average chemical analysis

| Feedstock material (for year 2000) | Chemical composition (/wt. %) | | | | | | | | | | | |
|---|---|---|---|---|---|---|---|---|---|---|---|---|
| | $TiO_2$ | $Ti_2O_3$ | FeO | MgO | $Al_2O_3$ | $SiO_2$ | $V_2O_5$ | CaO | MnO | Fe (metal) | $Cr_2O_3$ | $ZrO_2$ |
| Sorelslag ® | 78.20 | 15.60 | 11.00 | 5.30 | 3.20 | 2.80 | 0.60 | 0.48 | 0.26 | 0.44 | 0.19 | 0.05 |
| RBM titania slag | 85.80 | 29.70 | 10.08 | 1.00 | 1.10 | 1.70 | 0.42 | 0.15 | 1.80 | 0.20 | 0.17 | 0.20 |
| Upgraded titania slag | 94.50 | — | 1.65 $Fe_2O_3$ | 0.72 | 0.50 | 1.74 | 0.39 | 0.07 | 0.03 | — | 0.07 | — |
| Synthetic rutile | 94.81 | 22.88 | 1.47 | 0.40 | 1.32 | 1.82 | 0.25 | 0.05 | 0.40 | 0.05 | 0.18 | 0.24 |
| Pure titanium dioxide | 99.80 | — | 0.00 | 0.00 | 0.00 | 0.00 | 0.00 | 0.00 | 0.00 | 0.00 | 0.00 | 0.00 |

TABLE 2

Physical properties of various feedstocks in the molten state

| Feedstock material | Liquidus or melting temperature (/° C.) | Density at 1700° C. (/kg · $m^{-3}$) |
|---|---|---|
| Sorelslag ® (2000) | 1690 | 3510 |
| RBM titania slag | 1677 | 3680 |
| Upgraded titania slag | 1820 | |

TABLE 2-continued

Physical properties of various feedstocks in the molten state

| Feedstock material | Liquidus or melting temperature (/° C.) | Density at 1700° C. (/kg · $m^{-3}$) |
|---|---|---|
| Synthetic rutile | 1825 | |
| Pure titanium dioxide | 1855 | 3650 |

TABLE 3

Experimental electrochemical deoxidation results (cathodic current density of 5 kA · $m^{-2}$)

| EXAMPLE | CATHODE MATERIAL (−) | CATHODE PREPARATION | MOLTEN SALT OR SOLID ELECTROLYTE | CARBON ANODE MATERIAL (+) | ELECTROLYSIS TEMPERATURE (T/° C.) | FARADAIC EFFICIENCY ($\epsilon_I$/%) | ENERGY EFFICIENCY ($\epsilon_E$/%) | SPECIFIC ENERGY CONSUMPTION ($E_M$/ KWH · $KG^{-1}$) |
|---|---|---|---|---|---|---|---|---|
| Example 1 | solid titania slag (85 wt. % $TiO_2$) | Melted at 1700° C. and solidified | pure $CaCl_2$ | Semi-graphite (SGL carbon) | 950 | 0.9 | 0.5 | 700 |
| Example 2 | solid titania slag (85 wt. % $TiO_2$) | Melted at 1700° C. and solidified | pure $CaCl_2$ | Semi-graphite (SGL carbon) | 1100 | 2.4 | 1.2 | 346 |
| Example 3 | solid titania slag (85 wt. % $TiO_2$) | Melted at 1700° C. and solidified | pure $CaCl_2$ | Semi-graphite (SGL carbon) | 1350 | 24 | 12.9 | 32 |
| Example 4 | solid titania slag (85 wt. % $TiO_2$) | Ground and sintered at 1450° C. | pure $CaCl_2$ | Semi-graphite (SGL carbon) | 1350 | 36 | 21.1 | 18 |
| Example 5 | molten titania slag (85 wt. % $TiO_2$) | Nil | pure $CaF_2$ | Semi-graphite (SGL carbon) | 1700 | 90 | 56 | 7.0 |
| Example 6 | molten titania slag (80 wt. % $TiO_2$) | Nil | pure $CaF_2$ | Semi-graphite (SGL carbon) | 1700 | 90 | 56 | 7.0 |
| Example 7 | molten upgraded slag (92 wt. % $TiO_2$) | Nil | pure $CaF_2$ | Semi-graphite (SGL carbon) | 1800 | 92 | 57 | 7.0 |
| Example 8 | molten synthetic rutile (95 wt. % $TiO_2$) | Nil | pure $CaF_2$ | Semi-graphite (SGL carbon) | 1850 | 94 | 60 | 7.0 |
| Example 9 | molten titanium dioxide (99.9 wt. % $TiO_2$) | Nil | pure $CaF_2$ | Semi-graphite (SGL carbon) | 1860 | 95 | 62 | 7.0 |

Thus, the preferred method of the present invention confers numerous benefits heretofore unfound in the prior art. These benefits are most apparent when inexpensive titania slag is used as a feedstock. Indeed, the benefits are: (1) the excellent electronic conductivity of the molten titania slag reduces the ohmic drop and hence the overall cell voltage resulting in a much lower specific energy consumption; (2) taking advantage of the elevated sensible and latent heat of the molten titania slag because it can be transferred directly from an electric arc furnace allows to achieve electrolysis at high temperatures; (3) the elevated operating temperature preferably ranging between 1570° C. and 1860° C. depending on the FeO content and other impurities of the titania slag allows an excellent electrochemical reaction kinetics. (4) above liquidus temperature titania slag exhibits a low dynamic viscosity and a much lower density (e.g., 3510 $kg \cdot m^{-3}$ for 80 wt. % $TiO_2$ at 1700° C.) lower than that of pure and liquid titanium (e.g., 4082 $kg \cdot m^{-3}$ at 1700° C.). Hence firstly iron metal and other metals more noble than titanium (Mn, Cr, y, etc.) are first to be deoxidized electrochemically. This allows separation of these metals for the later produced deoxidized titanium. Owing to the higher density of the pure liquid iron (e.g., 6886 $kg \cdot m^{-3}$ at 1700° C.) and other metals compared to that of the molten titania slag (3510 $kg \cdot m^3$ at 1700° C.), the liquid metal droplets sink quickly by gravity settling to the bottom of the electrolyser forming a pool of metallic alloy while oxygen anions diffuse and migrate through the molten salt electrolyte to the consumable carbon anode where carbon dioxide gas is evolved. This first electrochemical reaction corresponds to the carbothermic reduction of metallic oxides with a reaction scheme given by:

$$M_xO_y(\text{liq.})+(y/2)C(\text{sol.})=xM(\text{liq.})\downarrow+(y/2)CO_2(\text{gas})\uparrow$$

Once all the iron and other metallic impurities are removed by this selective electrodeposition, the temperature is preferably increased to 1800° C. to compensate the enhanced content of $TiO_2$ of the purer titania slag. Meanwhile, electrochemical deoxidation carries on with the electrodeposition of droplets of liquid titanium metal at the slag electrolyte interface while oxygen anions diffuse and migrate through the molten salt electrolyte to the anode(s) where carbon dioxide gas is evolved. Because the molten titania slag has a low dynamic viscosity and exhibits a much lower density (e.g., 3510 $kg \cdot m^{-3}$ for 80 wt. % $TiO_2$ at 1700° C.) than that of pure and liquid titanium (e.g., 4082 $kg \cdot m^{-3}$ at 1700° C.), the liquid titanium droplets fall by gravity settling at the bottom of the electrolytic cell forming after coalescence a pool of pure liquid titanium metal that accumulate at the bottom of the electrolyser. This pool of pure liquid titanium metal never impedes the oxygen diffusion at the slag electrolyte interface and allows the straightforward continuous tapping of the titanium metal under inert atmosphere for casting large titanium ingots without requiring labor intensive and energy demanding steps to transform a sponge into ingots. This is of great benefit when comparing the cost-efficiency of the present inventive method to known processes for making titanium sponge. The overall electrochemical reaction corresponds to the carbothermic reduction of titanium dioxide with a reaction scheme given by:

$$TiO_2(\text{liq.})+C(\text{sol.})=Ti(\text{liq.})\downarrow+CO_2(\text{gas})\uparrow$$

In addition conducting the electrolysis into appropriate electrolytes having a wide decomposition potentials, elevated ionic conductivity, low vapor pressure, and excellent capability to dissolve large amount of oxygen anion permit to operate at elevated current densities of several $kA \cdot m^{-2}$ impossible in the prior art.

NOTES

[1] Cardarelli, F (2001)—*Materials Handbook: A Concise Desktop Reference*.—Springer-Verlag, London, New York, pages 115-135.

[2] Gambogi, J.—Titanium and Titanium Dioxide—from *Mineral Commodity Summaries*.—U.S. Bureau of Mines (1995) p. 180.

[3] Gambogi, J.—*Annual Report: Titanium*-1992—U.S. Bureau of Mines (1993) p. 1.

[4] Kroll, W. J.—*Trans. Electrochem. Soc.* 112(1940)35-47.

[5] Kroll, W. J.—Method for the manufacturing titanium and alloys thereof.—U.S. Pat. No. 2,205,854, June 25 1940.

[6] National Materials Advisory Board Committee on Direct Reduction Processes for the Production of Titanium Metal. 1974. Report # NMAB-304, National Academy of Sciences, Washington, D.C.

[7] Kolthoff, M.; and Thomas, J.—Polarography in acetonitrile of titanium tetrachloride and tetraiodide in various supporting electrolytes—*J. Electrochem. Soc.* 111(9)(1964) 1065-1074.

[8] Sinha, N. H.; and Swarup, D.—*Indian Mining J. Spec.* 1(1975)134.

[9] Kudryatsev, V. N.; Lyakhov, B. F.; Anufriev, W. G.; and Pedan, K. S.—*Hydrog. Met. Proc. Int. Cong. 2nd*. Pergamon Press, Oxford 1977, page 5.

[10] Sofronkov, A. N.; Prvii, E. N.; Presnov, V. N.; and Semizorov, N. F.—*Zh. Prikl. Khim.* 51(1978)607

[11] Bribiesca, S. L.; Contreras, E. S.; and Tavera, F. J.—Electrowinning of titanium from sulfuric acid titanium solutions.—*Proc. Titanium'92*, The Minerals, Metals, and Materials Society 1993, pages 2443-2444.

[12] Biallozor, S.; and Lisowska, A.—*Electrochim. Acta* 25(1980)1209.

[13] Lisowska, A.; and Biallozor, S.—*Electrochim. Acta* 27(1982)105.

[14] Abbott, A. P.; Bettley, A.; and Schiffrin, D. J.—*J. Electroanal. Chem.* 347(1993)153-164.

[15] Cardarelli, F., Taxil, P., and Savall, A.—Tantalum Protective Thin Coating Techniques for the Chemical Process Industry: Molten Salts Electrocoating as New Alternative—*Int. J. Refractory Metals & Hard Materials* 14(1996) 365-381.

[16] Delimarskii, Iu. K.; and Markov, B. F. (1961)—*Electrochemistry of Fused Salts*.—Sigma Press Publishing, New York.

[17] Lantelme, F.; Inman, D.; and Lovering, D. G. (1984)—Electrochemistry-I, in *Molten Salt Techniques*, Lovering, D. G.; Gale, R. J. (Eds.) Vol. 2., Plenum Press, New York, pp. 138-220.

[18] Leone, O. Q., Knudsen, H., and Couch, D. E.—High-purity titanium electrowon from titanium tetrachloride.—*J.O.M.* 19(3)(1967)18-23

[19] Couch, D. E., Leone, O. Q., Lang, R. S., and Blue, D. D.—Evaluation of diaphragm materials for electrowinning high-purity titanium. *Proc. Extractive Met. Div. Symp., Met. Soc. AIME* Chicago Ill. Dec. 11-13 1967, pp. 309-323.

[20] Leone, O. Q, and Couch, D. E. (1972)—Use of composite diaphragms in the electrowinning of titanium.—*Report Investigation* #7648, U.S. Dept. of Interior, Bureau of Mines, Washington D.C.

[21] Priscu, J. C.—*Symp. on Electrometallurgy, Proc. AIME Extractive Metallurgy Div*, Cleveland Ohio, December 1968, page 83.

[22] Priscu, J. C.—Electrolytic cell for the production of titanium.—U.S. Pat. No. 3,282,822, Nov. 1, 1966.

[23] Hashimoto, Y.; Uriya, K.; and Kono, R.—Electrowinning of titanium from its oxides. Part I. Fused salt electrolysis at temperatures above the melting point of the metal.—*Denki Kagaku* 39(6) (1971)516-522.

[24] Hashimoto, Y.—Electrowinning of titanium from its oxides. Part II. Influences of fluoride salt baths on fused-salt electrodeposition of titanium metal from titanium dioxide.—*Denki Kagaku* 39(12) (1971)938-943.

[25] Hashimoto, Y.—Electrowinning of titanium from its oxides. Part III. Electrowinning of titanium from titanium dioxide or calcium titanate in calcium fluoride-magnesium fluoride molten salt baths.—*Denki Kagaku* 40(1) (1972) 39-44.

[26] Anonymous—Costwise they call it less of a sponge.—*Amer. Metal Market* May 3, page 1-3 1973.

[27] Cobel, G.; Fisher, J.; and Snyder, L. E —Electrowinning of titanium from titanium tetrachloride: pilot plant experience and production plant projections 1969-1976.—*Conference: Titanium '80, Science and Technology*, Vol. 3, Kyoto, Japan, 19-22 May 1980 TMS/AIME, Warrendale, Pa.

[28] Juckniess, P. R., and Johnson, D. R.—Method for electrowinning titanium.—U.S. Pat. No. 4,118,291; Oct. 3 (1978).

[29] May Cobel G., Fisher J., and Snyder L. (1980)—Electrowinning of titanium from titanium tetrachloride.—*4th International Conference on Titanium*, May 1980, Kyoto, Japan.

[30] Armand, M.—Process for the preparation of titanium by electrolysis.—U.S. Pat. No. 4,381,976, May 3 (1983).

[31] Armand, M.—Novel Apparatus and process for the $TiCl_4$ feed to electrolysis cells for the preparation of titanium.—U.S. Pat. No. 4,396,472, Aug. 2 (1983).

[32] Ginatta, M. V.; Orsello, G.; and Berruti, R.—A method for the electrolytic production of a polyvalent metal and equipment for carrying out the method.—PCT Int. Appl., 33 pp. WO 8910437 (1990).

[33] Ginatta, M. V.; and Orsello, G.—Plant for the electrolytic production of reactive metals in molten salt baths.—Eur. Pat. Appl. EP 210961 Apr. 2, 1987.

[34] DiMaria, E.—RMI gets license to make new type of titanium.—*Metalworking News*, Feb. 1, 1988.

[35] Kawakami, M.; Ooishi, M.; Takenaka, T.; and Suzuki, T.—The possibility of electrowinning of liquid titanium using ESR apparatus.—*Proc. Int. Conf. Molten Slags, Fluxes Salts '97, 5th* (1997) 477-482 Iron and Steel Society, Warrendale, Pa.

[36] Takenaka, T.; Suzuki, T.; Ishikawa, M.; Fukasawa, E.; and Kawakami, M.—The new concept for electrowinning process of liquid titanium metal in molten salt.—Electrochemistry 67(6) (1999) 661-668.

[37] Takenaka, T.; Ishikawa, M.; and Kawakami, M.—Direct electrowinning of liquid titanium metal by using direct current electro slag remelting apparatus.—*Proc. Electrochem. Soc.* (Molten Salts XII) (2000) 99-41 578-584.

[38] Ginatta, M. V.—Process for the Electrolytic Production of Metal.—U.S. Pat. No. 6,074,045, Jun. 13 2000.

[39] Chen, G. Z; Fray, D. J.; and Farthing, T. W.—Direct electrochemical reduction of titanium dioxide to titanium in molten calcium chloride.—*Nature* 407(2000)361-364.

[40] Fray, D. J.; Farthing, T. W.; and Chen, G. Z.—Removal of oxygen from metal oxides and solids solutions by electrolysis in a fused salt.—*Int. Pat. Appl.* WO 99/64638 Dec. 16, 1999.

[41] Ward-Close, C. M.; and Godfrey, A. B.—Electrolytic reduction of metal oxides such as titanium dioxide and process applications.—*Int. Pat. Appl.* WO 01/62996 Feb. 20, 2001.

[42] Ward-Close, C. M.; and Godfrey, A. B.—Method of manufacture for ferro-titanium and other metal alloys by electrolytic production.—*Int. Pat. Appl.* WO 01/62994 Feb. 19, 2001

[43] *Financial Times* Dec. 21, 2000, page 12.

[44] Nakamura, M.; Okabe, T. H.; Oishi, T.; and Ono. K.—Electrochemical deoxidation of titanium.—*Proc. Electrochem. Soc.* Molten Salt Chemistry and Technology (1993)93-99.

[45] Okabe, T. H.; Nakamura, M.; Oishi, T.; and Ono. K.—*Metall. Trans. B* 24B(1993)449-455.

[46] Okabe, T. H.; Deura, T. N.; Oishi, T., Ono. K.; and Sadoway, D. R.—*J. Alloys Compounds* 282(1996)155-164.

[47] Sharma, R. A.—Molten salt process for producing titanium or zirconium powder.—U.S. Pat. No. 6,117,208 Sep. 12, 2000.

[48] Fortin, C.—Process for obtaining titanium or other metals using shuttle alloys.—U.S. Pat. No. 6,245,211, Jun. 12, 2001.

[49] Pal, U. B.; Woolley, D. E.; and Kenney, G. B.—Emerging SOM technology for the green synthesis of metals from oxides.—J.O.M. October (2001) 32-35.

[50] Pal, U.; Britten, S. C.—Method and apparatus for metal extraction and sensor device related thereto.—U.S. Pat. No. 5,976,345, Nov. 2, 1999.

[51] Pal, U.; Britten, S. C.—Apparatus for metal extraction.—U.S. Pat. No. 6,299,742, Oct. 9, 2001.

[52] Andersson, S.; Collen, B.; Kuylenstierna, U.; and Magneli, A. *Acta Chem. Scand.* 11(1957)1641.

[53] Hayfield, P. C. S.—Electrode material, electrode and electrochemical cell.—U.S. U.S. Pat. No. 4,422,917 Dec. 27, 1983.

[54] Cardarelli, F (2001)—*Materials Handbook: A Concise Desktop Reference*.—Springer-Verlag London Ltd., London, pages 329-330.

[55] Clarke, R.; and Pardoe, R.—Applications of Ebonex® conductive ceramic electrodes in effluent treatment.—in Genders, D; and Weinberg; N. L.—*Electrochemistry for a Cleaner Environment*.—Electrosynthesis Company Inc., East Amherst, N.Y. (1992) Chap. 18, pages 349-363).

[56] ASTM B299-99—*Standard Specification for Titanium Sponge*.—American Society for Testing and Materials (ASTM)

[57] ASTM B299-99—*Standard Specification for Titanium Sponge*.—American Society for Testing and Materials (ASTM)

The invention claimed is:

1. A method for electrowinning titanium metal or titanium alloy from conductive titanium oxide containing compounds selected from titanium oxides, ferro-titanium oxides, titanium compounds and mixtures thereof, said method comprising:

(a) providing the conductive titanium oxide containing compound at temperatures corresponding to the liquid state so as to provide a molten material;

(b) pouring the molten material into an electrochemical reactor to form a pool of electronically conductive liquid acting as molten cathode material;

(c) covering the molten cathode material with a layer of a molten salt electrolyte, hence providing an interface between the molten cathode material and the electrolyte;

(d) providing at least one anode in direct contact with said molten salt electrolyte, said anode(s) being operatively connected to an electrical current source;

(e) deoxidizing electrochemically the molten cathode at the interface with the electrolyte by electrolysis induced by said current source and circulating between the anode and cathode;

(f) recovering the resulting titanium metal or titanium alloy.

2. The method of claim 1 wherein in (f), the deoxidized titanium metal or alloy is selected from pure titanium, ferro-titanium or an alloy of titanium and another element including but not restricted to Fe, Ni, Co, Zr, Hf, Cr, Mo, W, Mn, Re, V, Nb, Ta, Al, Si, Cu.

3. A method for electrowinning titanium metal or titanium alloy from conductive titanium oxide containing compounds selected from titanium oxides, ferro-titanium oxides, titanium compounds and mixtures thereof, said method comprising:

(a) providing the conductive titanium oxide containing compound at temperatures corresponding to the liquid state so as to provide a molten electronically conductive material to be used as a molten cathode material;

(b) providing a molten salt electrolyte in an electrochemical reactor;

(c) pouring the molten cathode material into said electrolyte and allowing separation based on relative densities with settling of the molten cathode material as a layer under the molten electrolyte, hence providing an interface between the molten cathode material and the electrolyte;

(d) providing at least one anode in direct contact with said molten salt electrolyte, said anode(s) being operatively connected to an electrical current source;

(e) deoxidizing electrochemically the molten cathode at the interface with the electrolyte by electrolysis induced by said current source and circulating between the anode and cathode;

(f) recovering the resulting deoxidized titanium metal or titanium alloy.

4. A method according to any one of claims 1 to 3, wherein the conductive titanium oxide containing compounds are selected from titania slag, upgraded titania slag, ilmenite, hemo-ilmenite, titano-magnetite, leucoxene, perovskite, titanite, natural rutile, synthetic rutile, titanium dioxide and mixtures thereof.

5. A method according to claim 4 wherein the conductive titanium oxide is titania slag.

6. A method according to claim 5 wherein in (a) the titania slag is transferred in the molten state from a smelter operation.

7. A method according to claim 1 or 3, wherein in (d) the anode(s) is (are) selected from the group of anodes consisting of consumable carbon based anodes, soluble anodes and inert dimensionally stable anodes.

8. A method according to claim 7, wherein the anode(s) is (are) consumable carbon based anode(s).

9. A method according to claim 7, wherein the anode(s) is (are) a soluble anode made of electronically conductive titanium compounds such as titanium oxides, carbides, silicides, borides, nitrides and mixtures thereof.

10. A method according to claim 7, wherein the anode(s) is (are) an inert dimensionally stable anode.

11. A method according to claim 1 or 3, wherein (e) is conducted at a high temperature ranging between 1700° C. and 2500° C., but preferably between 1700° C. and 2000° C., and more preferably between 1700° C. and 1900° C.

12. A method according to claim 1 or 3, wherein (e) is conducted by direct current electrolysis.

13. A method according to claim 1 or 3, wherein (f) is conducted when droplets of liquid titanium metal or titanium alloy are produced at the slag/electrolyte interface and sink by gravity settling to the bottom of the electrochemical reactor forming, after coalescence, a pool of liquid deoxidized titanium metal or titanium alloy which may be tapped.

14. The method of claim 13 wherein the tapping is conducted under inert atmosphere and the liquid titanium metal or titanium alloy is cast into dense and coherent ingots.

15. A method according to claim 1 or 3, wherein the electrochemical reactor is shielded from internal corrosion by externally cooling the walls thereof so as to maintain a protective solid frozen skull layer of titanium oxide containing compound, titanium metal or alloy and solid electrolyte.

16. A method according to claim 1 or 3, wherein (a) through (f) are conducted on a continuous basis wherein the molten titanium oxide containing compound is continuously introduced in the electrochemical reactor and used as a permanent liquid cathode material.

17. A method according to claim 1 or 3, wherein the electrolyte is a molten inorganic salt $M_nX_m$ wherein M=Li, Na, K, Rb, Cs, Be, Mg, Ca, Sr, Ba and the anion (X) is selected among the groups of oxides, fluorides, chlorides, bromides, iodides, silicates, aluminates, titanates, sulfates, nitrates, carbonates, borates, phosphates or mixtures thereof, preferably alkali-metals and alkali-earth metals halides, but more preferably alkali-metals and alkali-earth metals fluorides, most preferably $CaF_2$ and $CaF_2$-CaO, with the proviso that the electrolyte is not calcium chloride.

* * * * *

UNITED STATES PATENT AND TRADEMARK OFFICE

CERTIFICATE OF CORRECTION

PATENT NO. : 7,504,017 B2
APPLICATION NO. : 10/450864
DATED : March 17, 2009
INVENTOR(S) : Francois Cardarelli It is certified that error appears in the above-identified patent and that said Letters Patent is hereby corrected as shown below:

Column 24; Claim 17, row 2, Please change “M=l.i.” to “M=Li”.

Signed and Sealed this

Twenty-eighth Day of April, 2009

JOHN DOLL
*Acting Director of the United States Patent and Trademark Office*